US010349767B2

(12) United States Patent
Ryan et al.

(10) Patent No.: US 10,349,767 B2
(45) Date of Patent: Jul. 16, 2019

(54) CUTLERY BUNDLE SECURING ASSEMBLY AND METHOD

(71) Applicant: Napkin Knots, LLC, New Berlin, WI (US)

(72) Inventors: Tracy Ryan, Claredon Hills, IL (US); Annie Dougherty, New Berlin, WI (US)

(73) Assignee: Napkin Knots, LLC, New Berlin, WI (US)

( * ) Notice: Subject to any disclaimer, the term of this patent is extended or adjusted under 35 U.S.C. 154(b) by 0 days.

(21) Appl. No.: 16/045,148

(22) Filed: Jul. 25, 2018

(65) Prior Publication Data

US 2018/0325295 A1 Nov. 15, 2018

Related U.S. Application Data

(63) Continuation of application No. 15/678,277, filed on Aug. 16, 2017.

(60) Provisional application No. 62/375,632, filed on Aug. 16, 2016.

(51) Int. Cl.
*A47G 21/16* (2006.01)
*A47G 21/14* (2006.01)

(52) U.S. Cl.
CPC ..... *A47G 21/16* (2013.01); *A47G 21/14* (2013.01)

(58) Field of Classification Search
CPC ..... A47G 21/14; A47G 21/16
See application file for complete search history.

(56) References Cited

U.S. PATENT DOCUMENTS

| | | | | | |
|---|---|---|---|---|---|
| 345,164 | A | | 7/1886 | Monroe | |
| 1,053,126 | A | | 2/1913 | Fuller | |
| 1,891,933 | A | | 12/1932 | James | |
| 1,940,351 | A | | 12/1933 | Howard | |
| 1,980,065 | A | | 11/1934 | Johnston | |
| 2,234,638 | A | * | 3/1941 | Topping | A63B 69/3632 280/821 |
| 2,547,487 | A | | 4/1951 | Frederic | |
| 3,026,639 | A | | 3/1962 | Lille | |
| 3,451,640 | A | | 6/1969 | Kieronski | |
| 3,451,649 | A | | 6/1969 | Bernard Weiss | |
| 3,965,591 | A | * | 6/1976 | Le Sueur | A47G 21/16 40/665 |
| 4,293,601 | A | | 10/1981 | Cole | |
| 4,467,503 | A | | 8/1984 | Boynton | |
| 4,506,371 | A | * | 3/1985 | Cross | G01K 1/04 156/245 |
| 4,884,321 | A | * | 12/1989 | Holub | A43C 7/00 24/712.6 |
| 4,982,641 | A | | 1/1991 | Duhart | |

(Continued)

*Primary Examiner* — Robert Sandy
*Assistant Examiner* — David M Upchurch
(74) *Attorney, Agent, or Firm* — Quarles & Brady LLP

(57) ABSTRACT

A utensil bundle assembly comprising a single strand having a first end and a second end and an intermediate portion therebetween, the intermediate portion forming a single slip knot through which the first and second ends pass, strand portions adjacent the first and second ends moveable through the slip knot to different locations to adjust the dimension of a loop portion formed by the strand and a placard including a front surface and a rear surface, the placard mounted to the loop portion of the strand with the front surface exposed.

20 Claims, 18 Drawing Sheets

(56) References Cited

U.S. PATENT DOCUMENTS

| | | | | | |
|---|---|---|---|---|---|
| 5,160,257 | A * | 11/1992 | Tsengas | A01K 87/00 | 43/22 |
| 5,487,924 | A * | 1/1996 | Fritze | A47G 21/16 | 24/7 |
| 6,161,314 | A * | 12/2000 | Kamrin | A43B 3/30 | 24/115 H |
| 6,694,779 | B1 * | 2/2004 | Dreger | A47G 21/16 | 63/15 |
| 7,152,280 | B1 * | 12/2006 | Taylor | A47G 21/16 | 24/7 |
| D658,087 | S * | 4/2012 | Rafaelian | D11/3 | |
| 2006/0226038 | A1 * | 10/2006 | Lampley | A45F 3/00 | 206/315.9 |
| 2007/0089333 | A1 * | 4/2007 | Cage | G09F 3/00 | 40/310 |
| 2008/0085656 | A1 | 4/2008 | Boise | | |
| 2010/0043181 | A1 | 2/2010 | Kiviniemi | | |
| 2010/0269306 | A1 * | 10/2010 | Read | A47G 21/16 | 24/1 |
| 2011/0048072 | A1 * | 3/2011 | Mullen | A43C 9/02 | 63/3.1 |
| 2014/0115842 | A1 * | 5/2014 | Sloan | A43C 19/00 | 24/712.2 |

* cited by examiner

CUTLERY BUNDLE SECURING ASSEMBLY AND METHOD

CROSS-REFERENCE TO RELATED APPLICATIONS

This application is a continuation of U.S. patent application Ser. No. 15/678,277 which was filed on Aug. 16, 2017 and which was titled "Cutlery Bundle Securing Assembly And Method" and also claims the benefit of U.S. Provisional Application No. 62/375,632 filed Aug. 16, 2016, all of which is incorporated herein by reference.

STATEMENT REGARDING FEDERALLY SPONSORED RESEARCH OR DEVELOPMENT

Not applicable.

BACKGROUND OF THE DISCLOSURE

The field of the disclosure is cutlery bundle holders and more specifically a mechanical assemblage for maintaining a napkin in a folded or bundled state.

When people entertain guests at their homes or other locations, they often want to make events special and memorable. One way to make events special and memorable is by decorating event venues in unique ways that reflect the reason an event is held. For instance, people routinely decorate their homes for Christmas parties, Easter parties, graduations, baby showers, Halloween, Fourth of July parties, etc. Another way to make events special and memorable is to serve special foods and beverages.

When food is served at an event, in most cases utensils and napkins are provided for use by each guest. In many cases when utensils and napkins are provided, a host will temporarily package those items together to form a utensil set that is easy for guests to grab and handle so that the guests do not have to individually select each item required to eat. For instance, in some cases a host may wrap a napkin around a stack of utensils including a knife, a fork and a spoon and may tuck a corner of the napkin into a napkin crease to secure the napkin about the utensil stack. As another instance, in some cases a host may simply tie a string about a napkin and utensil kit to maintain the kit in a bundled state until used.

Yet another solution to maintain a kit bundle has been to provide napkin rings that form cylindrical passageways where a napkin and utensil stack bundle are slid part way into the ring and the inner surface of the ring applies a compressing force on the bundle to maintain the napkin wrapped around the stack. In some cases, to accommodate different napkin thicknesses and utensil stack dimensions, a ring may include some type of elastic component so that the radial dimensions of the ring are flexible.

In many cases event hosts want napkin and utensil holders to compliment or even enhance their decorations for specific events. For example, a Christmas themed napkin ring may compliment a Christmas napkin, table decorations and other decorations within a host's home. As another example, a baby shower themed ring may compliment decorations for a baby shower. Other themed rings may be desirable for an Easter brunch, a Halloween party, a Fourth of July party, a retirement party, a wedding reception, etc.

Each of the bundle maintaining solutions above have shortcomings. Tucked napkin corners routinely become dislodged and therefore the bundles fall apart. Tied strings, like tucked corners, often become undone if the tied knot is loose or fragile when initially tied. In other cases where a string knot is robust, string removal is often cumbersome and annoying, especially for older guests who may have poor eye sight or difficulty undoing a tight knot. In addition, in the case of a tucked napkin or a knotted string, in known cases, these solutions cannot be used to enhance or compliment a themed event by including themed decoration, graphics, etc.

Non-flexible rings cannot optimally accommodate napkin and utensil bundles of different dimensions. In some cases a small dimensioned bundle may fit too loosely within a rigid ring while in other cases a large dimension bundle may not fit at all. Flexible rings having some elasticity to them are often flimsy and can be damaged if the elastic material is stretched too far.

In the case of themed rings, in most cases consumers are unable to justify the cost associated with the rings given how infrequently the themes associated with the rings occur. For instance, Christmas, Easter, Halloween and other holidays only happen once a year and other events like a wedding, retirement, a baptism, etc., may only occur once in a person's life so that the expense associated with themed rings cannot be justified by most event hosts.

In addition, while rings that are themed can be purchased, in most cases there is no easy way to further personalize those rings for individual and unique events. For instance, in known cases text cannot be added to a ring such as "Happy Anniversary" or "Congrats Sue and Jim". Similarly, personalized graphics like a person's image, a favorite design, etc., cannot be added to known rings.

Thus, there is a need for a better utensil bundle maintaining solution that can accommodate different dimension bundles, that is easy to tighten and release, that can be specially themed and that is inexpensive so that the assembly can be disposable if desired. In addition, it would be advantageous if the solution were reusable or easily re-themed so that a host that routinely entertains could change the solution appearance to customize for different events. Moreover, it would be advantageous in some cases if the solution allowed a host to quickly and easily customize graphics for specific events.

SUMMARY OF THE INVENTION

It has been recognized that a simple and inexpensive utensil bundle securing solution can be configured using a string that is tied into a double string slip knot loop that can be easily tightened and loosened about a utensil bundle to secure and release the bundle in an simple, quick and intuitive fashion. The string length can be sufficient to accommodate various bundle dimensions and therefore can be used with different bundle assemblies for different events. To secure a bundle the loop is loosened, the bundle inserted lengthwise through the loop opening and one end of the loop is pulled to tighten the loop about a central or other section of the bundle until the loop applies a force against an outer circumferential surface of the bundle. The force of the bundle on the facing surface of the loop causes friction between the string knot and an engaged surface of the string so that the loop remains frictionally locked until affirmatively loosened by a user. In at least some cases the string used to form the loop may be formed of a material that causes high friction so that the string is maintained in the secure state until affirmatively loosened by a user. For instance, in some cases, at least the portions of the string that form the slip knot and that pass through the knot are formed by a waxed cotton cord so that slip knot friction is substantial. Here, again, once tightened in the securing position, the outward force applied by the bundle (e.g., a resilient napkin about a utensil stack) causes the frictional force of the knot to be sufficient to eliminate the possibility of inadvertent release.

In at least some cases, in addition to forming the slip knot, the string may form a stop knot at a second end of the string opposite the slip knot where the stop knot dimensions restrict the stop knot from passing through the slip knot. Thus, here, a user cannot inadvertently loosen the loop to the point where the second end of the string is pulled out of the slip knot so that the loop is destroyed.

The string loop can be produced in many different colors so that the string itself may be themed in some fashion. For instance, the string loop may be red for Christmas, pink for Easter, gold for a fiftieth wedding anniversary, orange for Halloween, etc.

In at least some cases, in addition to the string loop, the solution will also include a decorative label assembly attached to the string that can be more specially themed for specific events. For instance, in at least some cases a planar placard may be appended to the string loop where an exterior surface of the placard includes themed indicia that can be specialized for a specific event. In at least some cases the placard may be formed of a thick fibrous card stock to minimize solution costs. In other cases the placard may be formed of a thin plastic or otherwise substantially rigid material. While the placard may be glued to the string loop in some cases, in particularly advantageous cases a sticker may be applied to a rear surface of the placard with a portion of the string passing between the rear placard surface and the sticky surface of the sticker so that the placard is restrained from moving along the length of the string. In at least some cases the string may include one or more knots adjacent the location along the string length at which the placard is to be attached to help maintain the placard secured to the string. For instance, the sticker and placard may be centered on a central knot to increase friction between the placard, sticker and string. In some cases two or more centering knots may be formed on the loop for optimally locating the placard and for increasing robustness of the securing mechanism.

While the placard and sticker may be semi-permanently applied to the string loop and intended only for one themed use like Halloween in some cases, in other cases it may be intended that the placard be removable and replaceable on the string by another placard having a different theme. For instance, in some cases multiple differently themed placard sets (e.g., 20 placards) may be provided to a host or at least made available to the host where the host can remove one set and replace the set with a second differently themed set for a different event. For example, a Christmas placard set may be replaced with a birthday placard set. In some cases replacement may include removing the placard stickers to release the first placard set and then using a second sticker to secure the second placard set to the string loops.

It is envisioned that, in some cases, a host may be provided with a solution set including string loops and a standard group of placard sets (e.g., birthday, Christmas, Easter, Halloween, retirement, etc.), where the host can customize loops to specific events. It is also envisioned that a host may be able to order replacement or other placard sets for delivery so that the string loops are reusable in some cases. Reusability is important in cases where the string loop material is relatively more substantial or has some additional functional or fanciful features and therefore is relatively more expensive. For instance, in some cases the string material may include a central fabric piece where only the ends of the loop assembly are formed of the waxed or other high friction cord material. In other cases two knot loop assemblies are contemplated that hold a loop material closed and release to open where the loop configuration is more expensive.

In some cases a host may be able to go on line and select from a large number of different themed placards to increase customization substantially. For instance, in some cases placard options may include 1000 different Christmas themed placard designs, 1000 differently themed Halloween designs, etc. Here, the host may select one or more placard designs and set numbers and have those placards delivered for assembly. Here, a set of securing stickers would be provided to compliment the number of placards ordered by the host.

In still other cases the placard may provide a receiving front surface for receiving a themed sticker that includes themed graphics or indicia. Thus, a front surface of the placard would be blank and a front surface of the sticker would provide the decorative graphic. Here, the placard may be constructed of a reusable material like plastic or may have a front surface that is specifically designed to receive and release the decorative sticker so that new themes could be accommodated by simply removing existing decorative stickers and replacing them with differently themed stickers.

In some cases it is contemplated that a host may be able to create their own graphics on line using a website. For instance, a host may be able to add text or other personalized graphics to a placard or sticker such as the name of a guest having a birthday, an image of a couple celebrating an anniversary, etc. In some cases after a new graphic is designed by a host, the graphic may be applied to string loops prior to delivery to the host and then the complete assembled solutions may be delivered. In other cases where a host already has reusable string loops, the newly designed placards may be delivered to the host for assembly by the host.

In still other cases it is contemplated that solution kits may be available that include sticker and/or placard stock that can be printed on using a standard colored printer device that many people have in their homes or can access at work. Here, a host may be able to select or design preferred themed graphics and have the graphics printed onto their sticker or placard stock which can then be applied to existing string loops for use.

DETAILED DESCRIPTION OF THE DISCLOSURE

Figure 1:
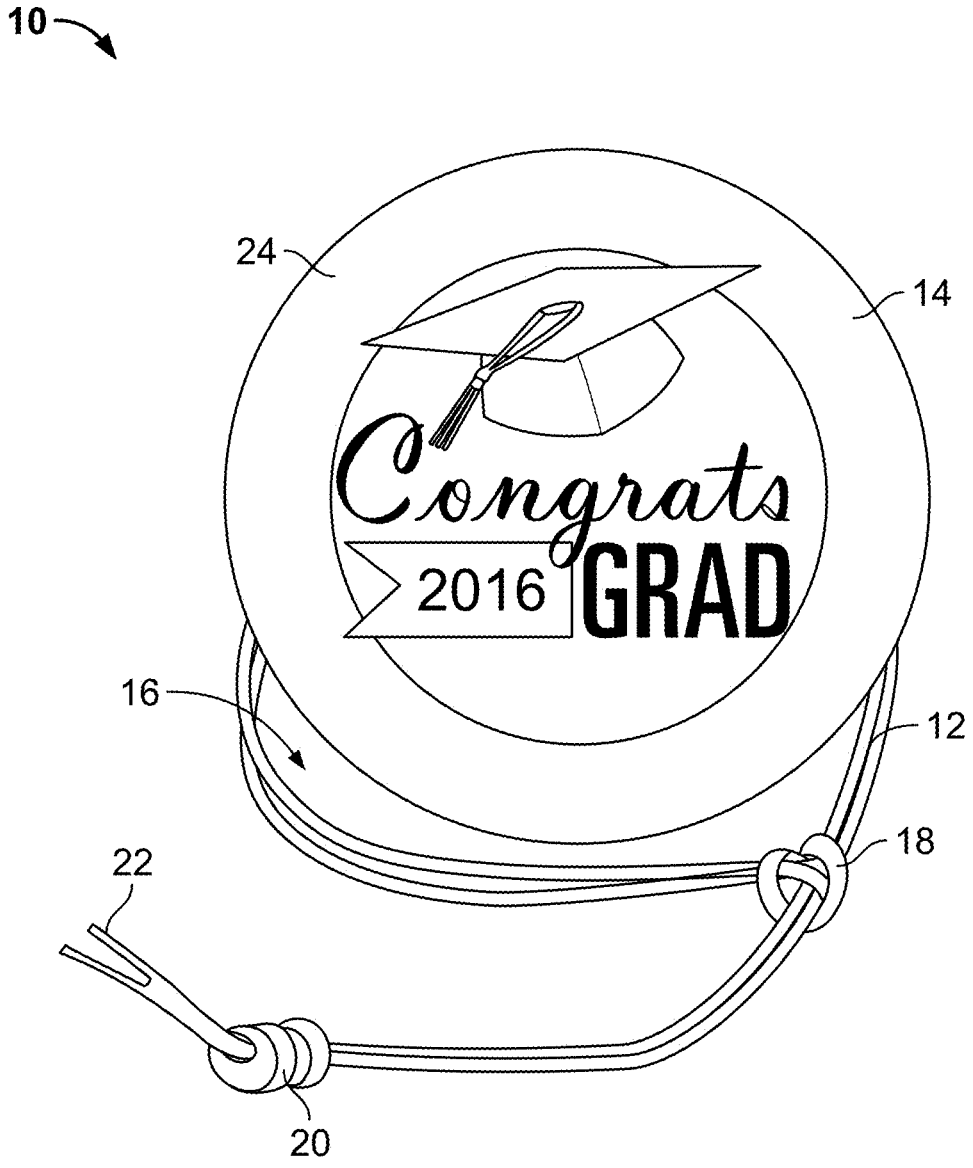
FIG. 1 is a perspective view of a utensil securing assembly that is consistent with at least some aspects of the present disclosure.

The various aspects of the subject disclosure are now described with reference to the drawings, wherein like reference numerals correspond to similar elements throughout the several views. It should be understood, however, that the drawings and detailed description hereafter relating thereto are not intended to limit the claimed subject matter to the particular form disclosed. Rather, the intention is to cover all modifications, equivalents, and alternatives falling within the spirit and scope of the claimed subject matter.

Figure 2:
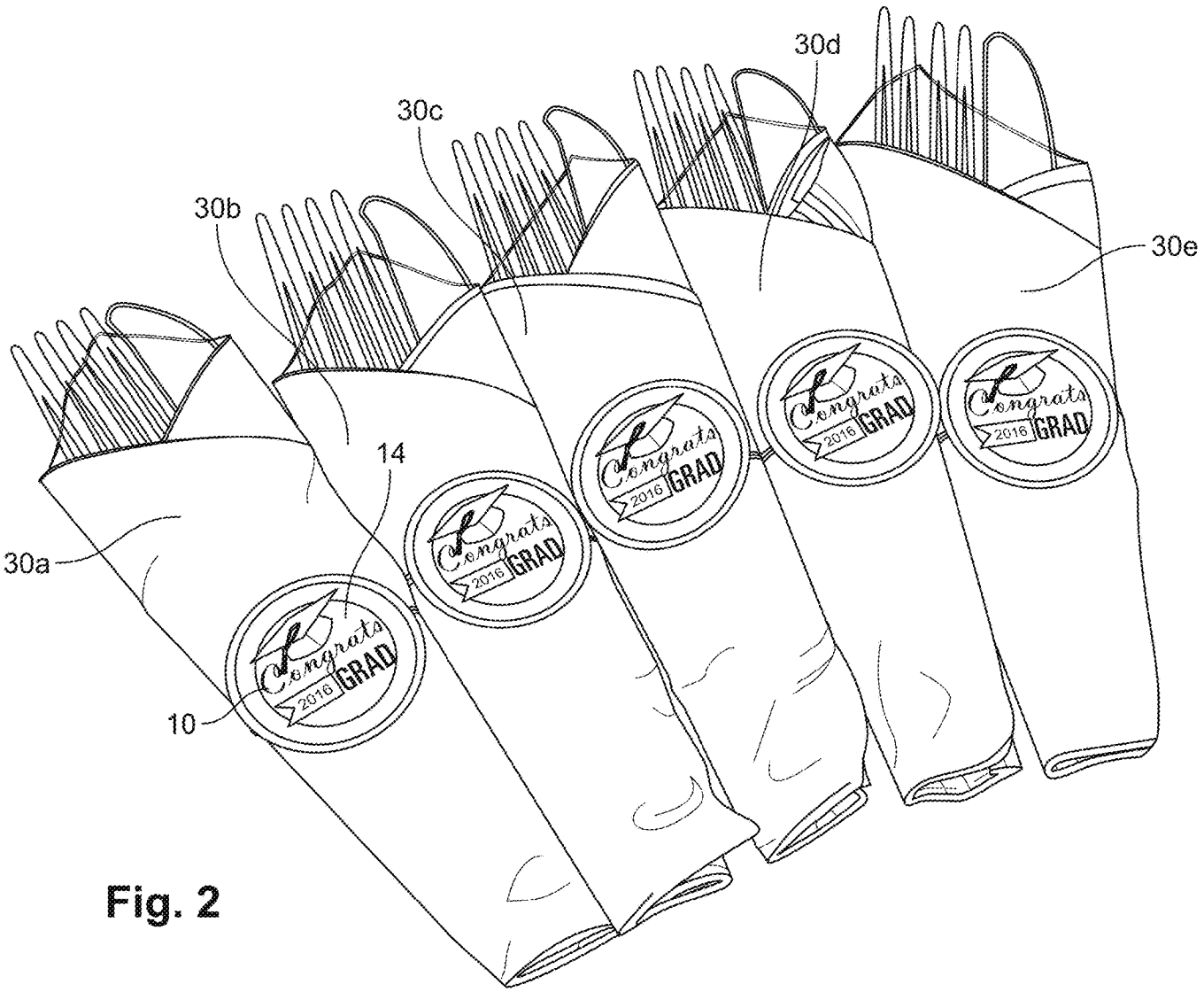
FIG. 2 is a perspective view of several utensil bundles secured via assemblies like the assembly shown in FIG. 1.
Figure 3:
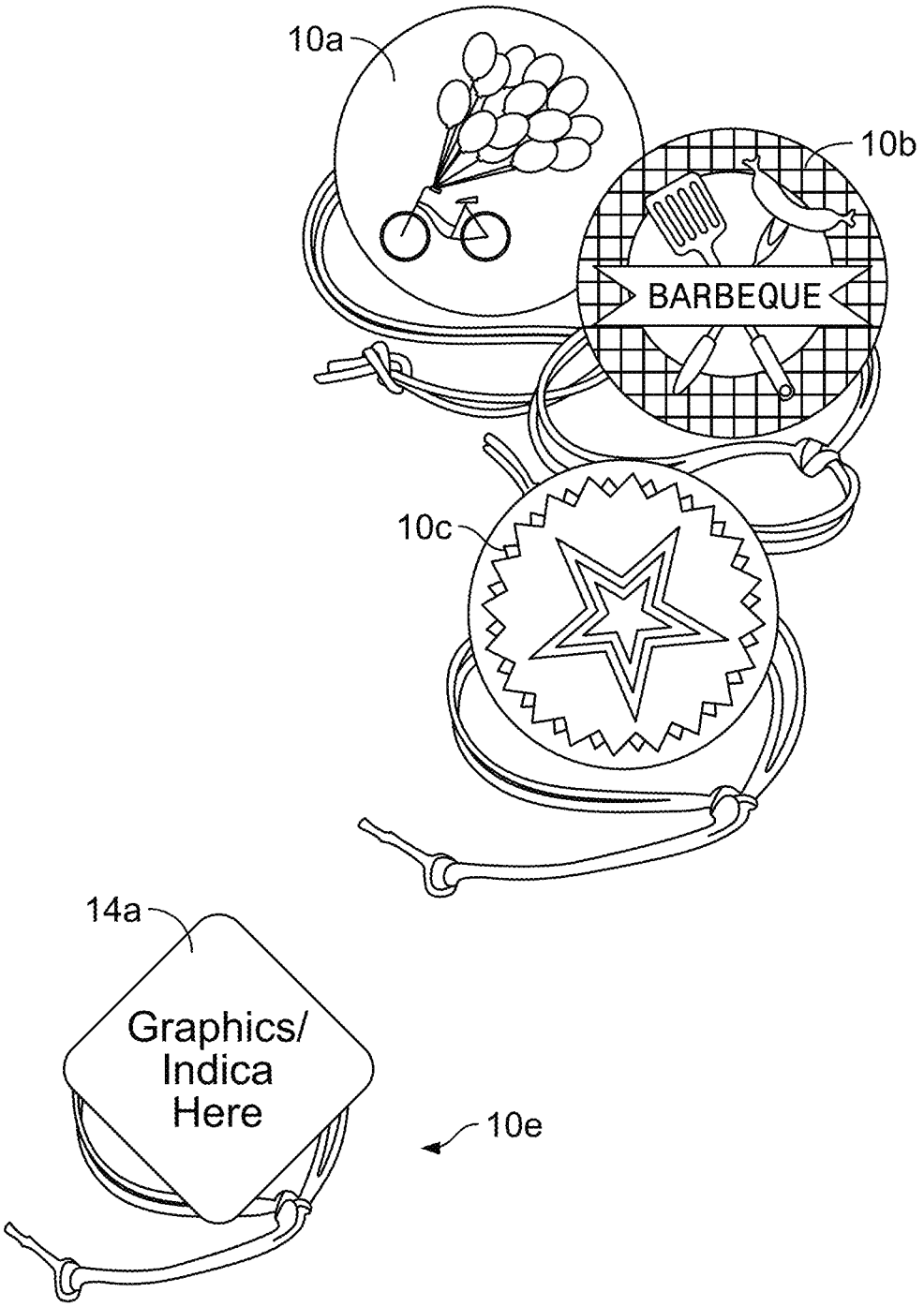
FIG. 3 is a view similar to the FIG. 1 view, albeit showing several assemblies, each having a different graphic applied to a front surface.
Figure 4:
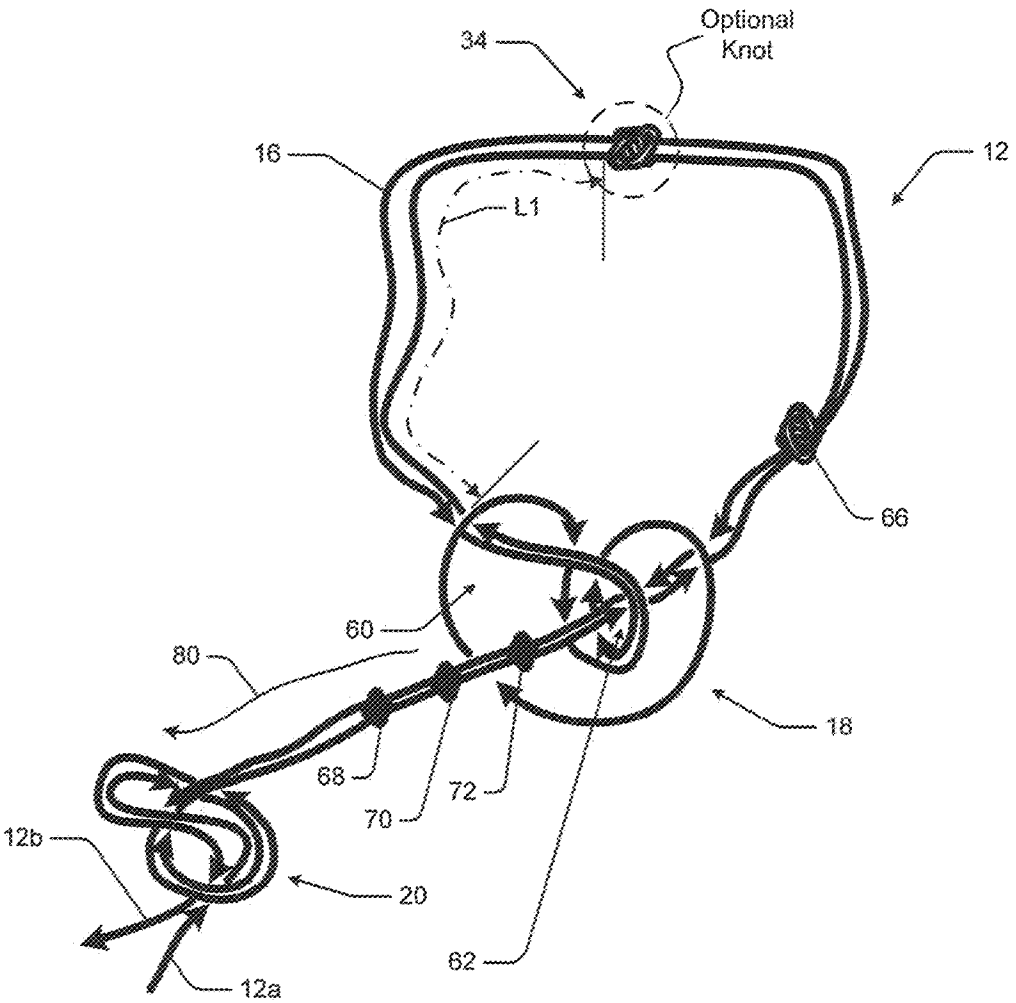
FIG. 4 is a schematic view of a strand arrangement that is consistent with at least some aspects of the present disclosure.
Figure 5:
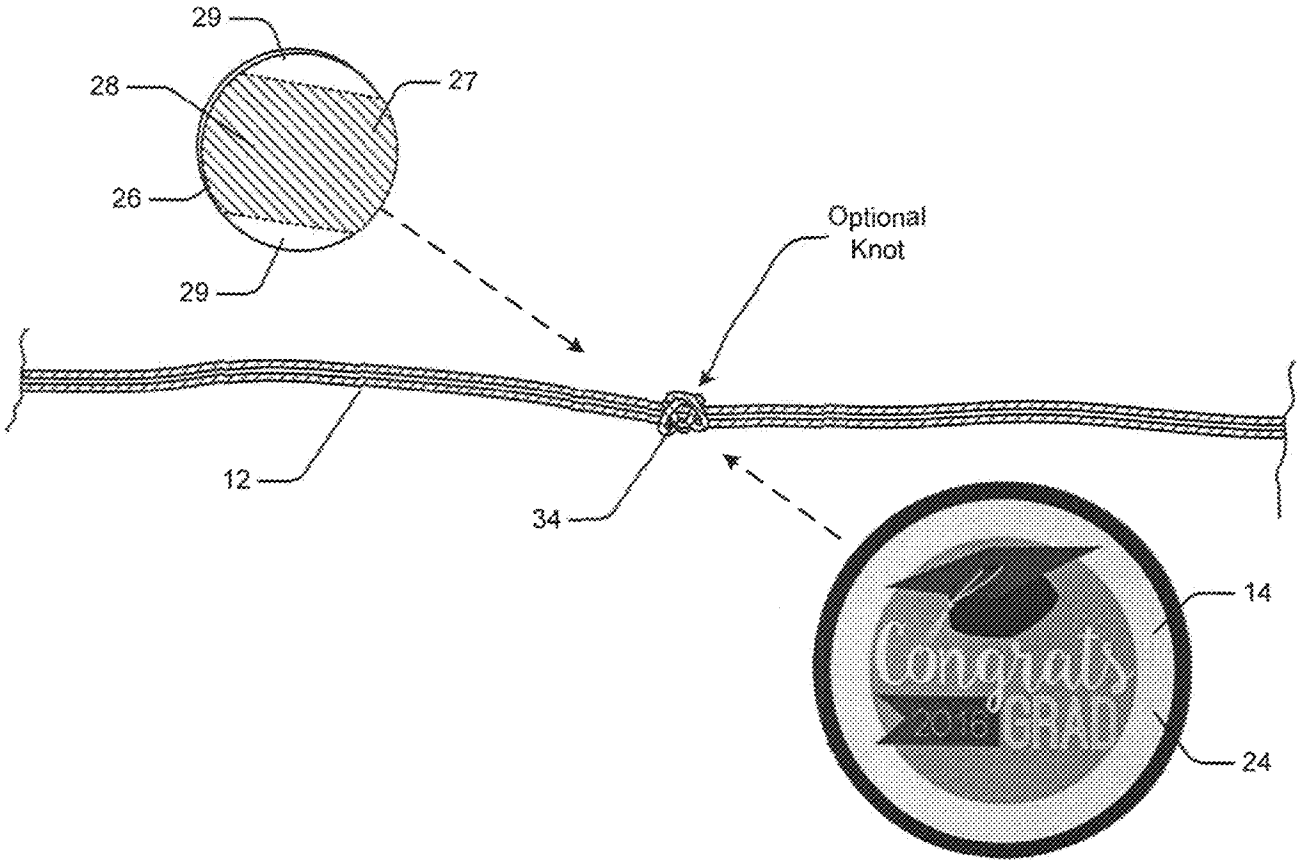
FIG. 5 is a partially exploded view of the assembly of FIG. 1.

Referring now to the figures and more specifically to FIGS. 1 through 3, the present disclosure will be described in the context of an exemplary bundle securing solution 10 (10*a*-10*e*) that may be used to secure a utensil bundle as shown generally in FIG. 2. Referring also to FIGS. 4 and 5, an exemplary solution 10 includes a single binding strand 12, a placard 14 and a sticker 26. The strand 12 is arranged to form a plurality of knots that cause the strand to form a loop 16. In at least some cases the strand forms at least a single slip knot 18 with an intermediate section of the strand 12 passing through a slip channel 62 formed by knot 18 (see FIG. 4). Here, the intermediate portion of the strand 12 may be pulled through the slip knot to change the dimensions of the loop 16 formed by strand 12 (e.g., to tighten or loosen the loop). Thus, with a utensil bundle located within the loop 16, a user can tighten loop 16 to secure the bundle for use and can loosen loop 16 to remove the bundle for use.

In at least some cases, strand 12 or at least the portion of the strand that forms the slip knot 128 and the intermediate strand section that passes through the knot 18 are formed of a relatively high friction strand material so that once pulled through the knot, a substantial degree of friction must be overcome to loosen the loop 16. For instance, in at least some cases, strand 12 may include a waxed braided cotton string to increase slip knot-strand friction. Once a loop 16 is tightened about a utensil bundle, the bundle is compressed in most cases. For instance, where a bundle includes a napkin wrapped about a knife, a fork and a spoon (see FIG. 2), the napkin is typically somewhat compressed and the compressed napkin acts as a sort of radial spring to apply a force against the force of the internal surface of loop 16, which further increases the friction between slip knot 18 and the strand section passing there through.

In at least some cases, strand 12 may also have some elasticity so that the strand can stretch at least a small amount and resiliently return to its rest length so that, upon being tightened about a utensil bundle, strand 12 also operates like an elongated spring to increase slip knot-strand friction. Here, while the entire strand may be somewhat elastic, in some cases only an intermediate portion of the strand within the loop area may be elastic to increase friction.

Referring now to FIG. 4, an exemplary strand arrangement 12 is illustrated that is formed via a single material strand. The strand 12 may have a length dimension prior to forming the arrangement 12 that is within a range between 6 inches and 15 inches and, in particularly advantageous embodiments the length may be within a range between 8 inches and 10 inches. Strand 12 includes first and second ends 12*a* and 12*b* and is tied in the illustrated arrangement to form slip knot 18. Moving from the first end 12*a*, the strand 12 extends to knot 18 and straight through the knot to the loop 16 section. Upon returning to knot 18, the strand loops about once around the strand to form slip knot channel at 62 and then loops a second time as at 60 about the strand to form a locking loop, and then a third time, the third loop also about channel 62 and then passes back through the locking loop 60 and back along the length of the strand to form a second ply of the loop 16 prior to again passing through the slip knot channel and ending in second strand end 12*b*. Once slip knot 18 is tightened, the knot appears as in FIG. 1. At this point, slip knot friction should maintain the loop 16 dimensions once set by a user unless affirmatively changed by the user (e.g., further tightening or loosening).

In addition to forming slip knot 18, strand 12 may also be tied to form other useful knots. For instance, stop knot 20 may be forms adjacent strand ends 12*a* and 12*b* as shown in FIG. 4 (see also knot 20 in FIG. 1). Knot 20 should be dimensioned so that knot 20 cannot pass through slip knot channel 62 so that the loop 16 cannot be inadvertently pulled open by a user to avoid an unintended disassembly of the loop 16. Similarly, in some cases a second stop knot 66 may be formed within the loop 16 on a side of slip knot 18 opposite the first stop knot 20 to avoid a case where a user pulls the loop 16 tight without any utensil bundle in the loop which could damage the placard 14 or other assembly components prior to use or could cause the loop 16 itself to become "knotted" and difficult to open. Thus, for instance, second stop knot 66 may restrict loop tightening so that the length of the loop 16 from the slip knot 18 is, at a minimum, anywhere between one half an inch and two and a half inches and, in particularly advantageous embodiments may limit the minimum length to within a range between one inch and one and one half inches.

Referring still to FIG. 4, in still other embodiments strand 12 may form one or more intermediate "detent" knots spaced apart adjacent the first stop knot 20, three of which are shown at 68, 70 and 72. Here, the detent knots 68, 70 and 72 have dimensions that are smaller than the stop knots 20 and 66 but that are slightly larger than a channel dimension formed by the slip knot channel 62 so that each detent knot can, when sufficient force is applied, pass through the slip knot channel 62 but will temporarily "lock" against the slip knot 18 when less than the slipping force is applied. Thus, the detent knots can increase the locking effectiveness of the assembly 10 in at least some embodiments.

Referring still to FIG. 4, in at least some cases, strand 12 may also form one or more placard engaging knots 34 along the length of the loop 16 section which, as the label implies, are provided to engage placard 14 when the placard 14 is secured to strand 12. Here, engaging knot 34 may be located a fixed distance from slip knot 18 to one side of knot 18 where the strand 12 slides through the slip knot 18 to the opposite side of the knot 18 to change loop dimensions. For instance, in some cases, a dimension L1 may be between one half an inch and two and a half inches and in particularly advantageous embodiments distance L1 may be between three quarters of an inch and two inches.

Once strand arrangement 12 is formed and the knots including slip knot 18 are tightened, the dimensions of loop 16 may be tightened by pulling on distal ends 12*a* and 12*b* so that strand 12 is slid through knot 18 as indicated by arrow 80. Similarly, loop 16 may be loosened by pulling on an intermediate section of the strand arrangement that forms loop 16 so that the strand slides in the direction opposite arrow 80 to increase loop 16 size.

Figure 6:
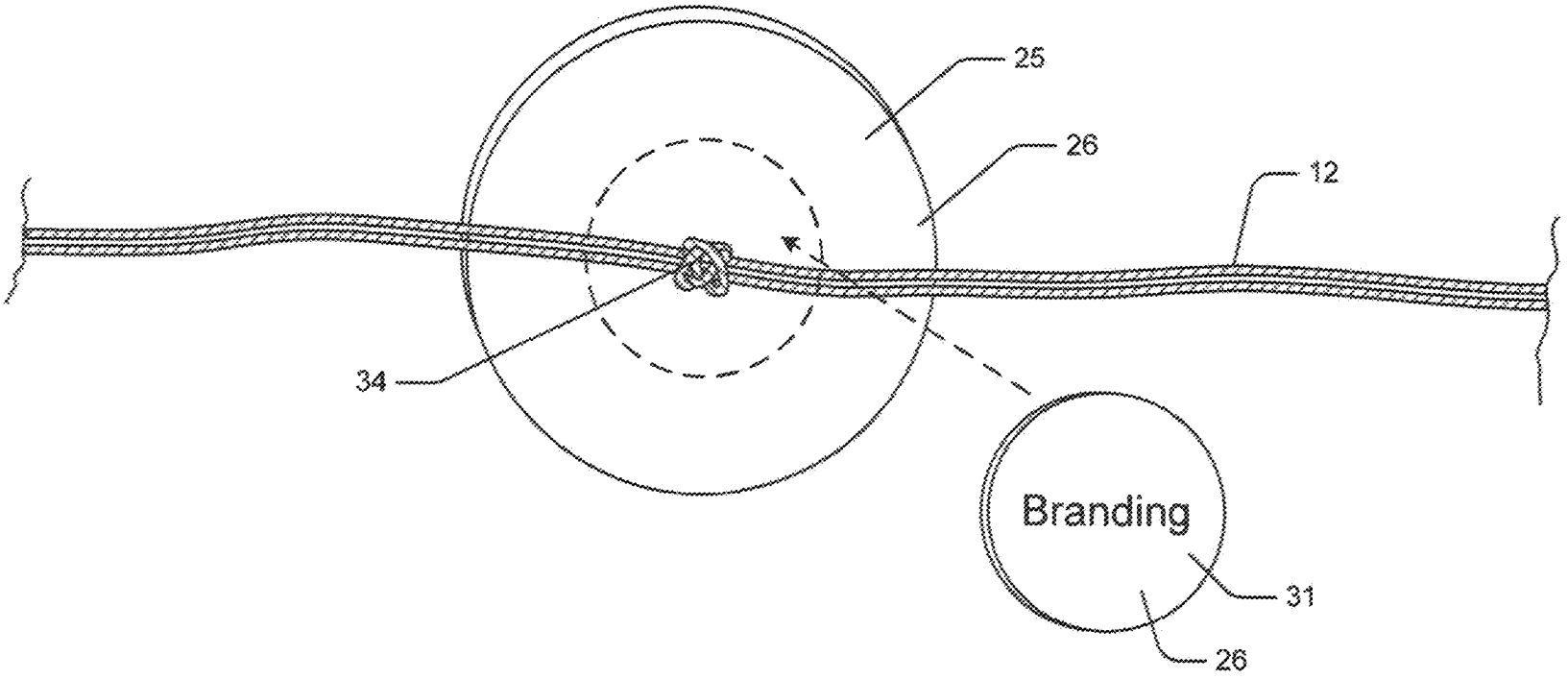
FIG. 6 is a partially exploded view of the assembly of FIG. 1.
Figure 7:
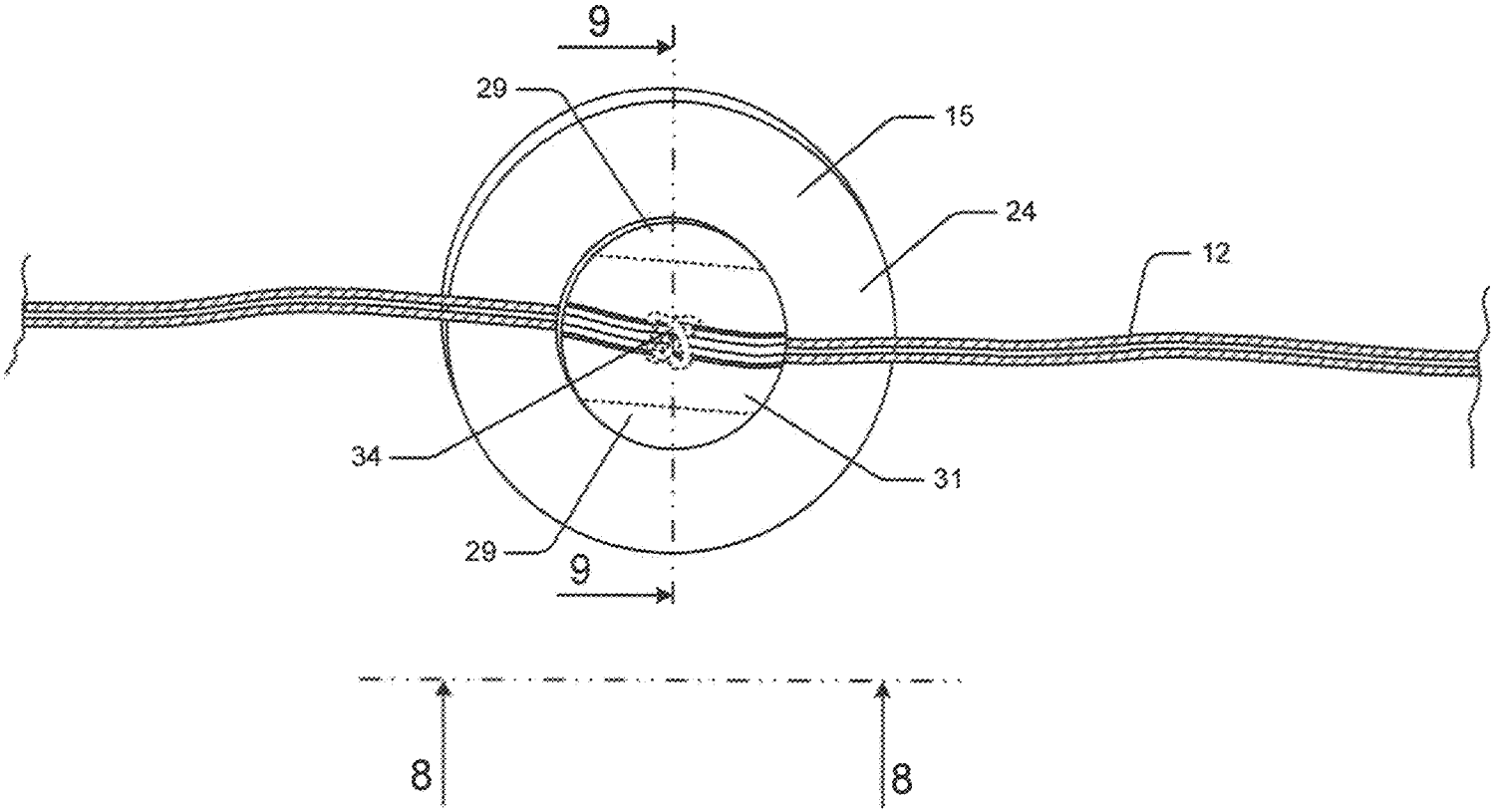
FIG. 7 is a rear view of the assembly of FIG. 1.
Figure 8:
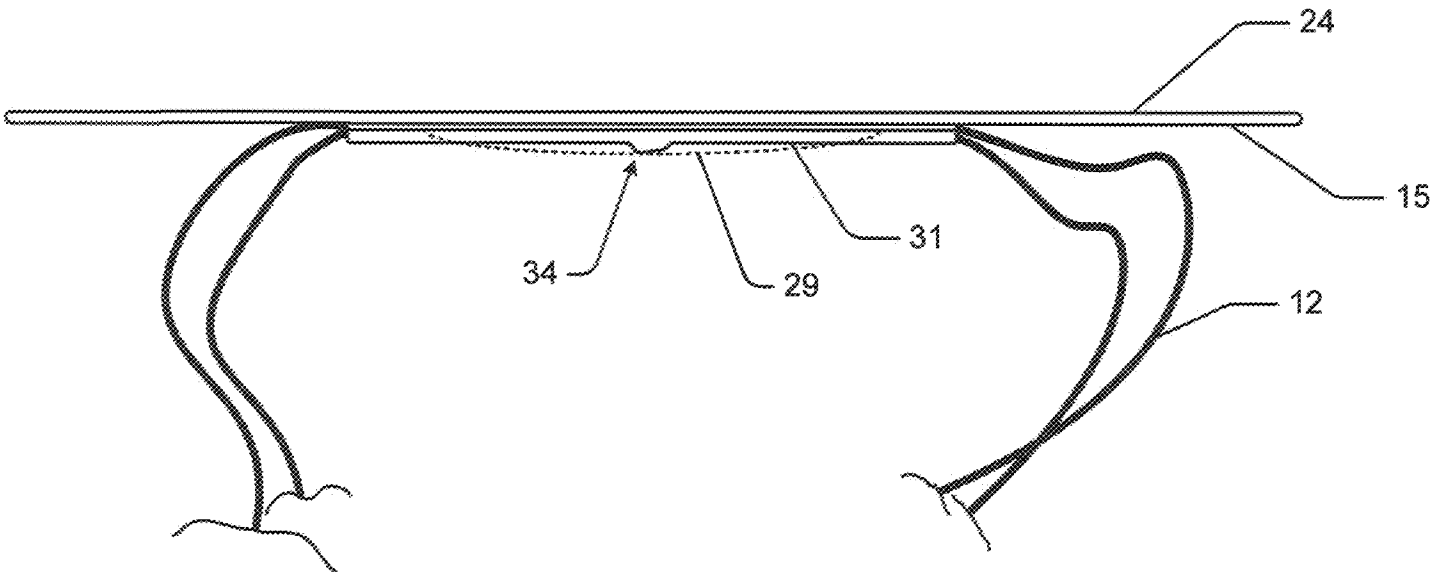
FIG. 8 is a side view of the assembly of FIG. 7 taken along the line 8-8 in FIG. 7.
Figure 9:
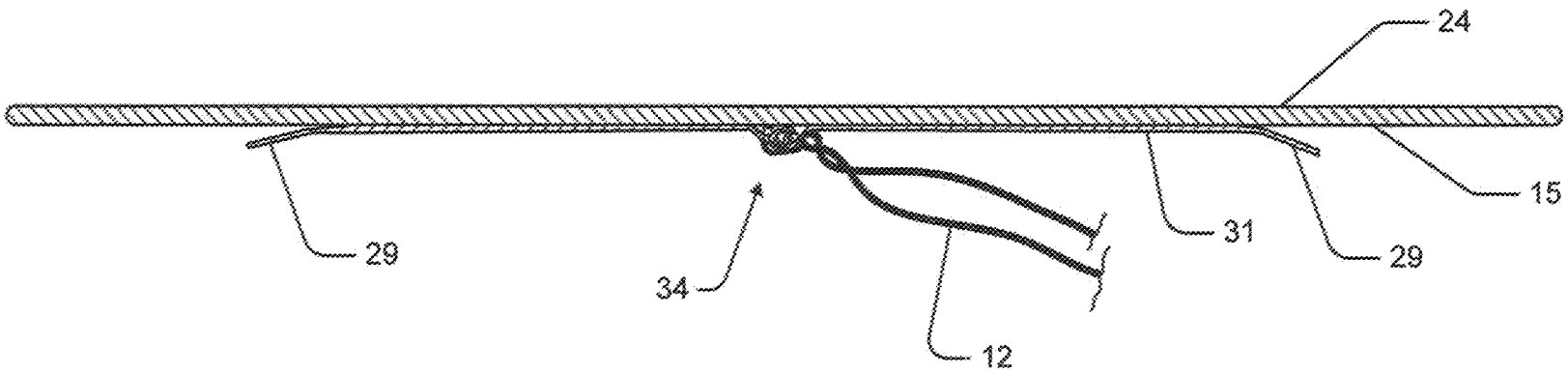
FIG. 9 is a cross sectional view taken along the line 9-9 in FIG. 7.

Referring still to FIG. 1, placard 14 is attached to the loop portion of the strand 12 at a location spaced apart from the slip knot 18 so that the placard does not interfere with tightening of the loop 16 about a utensil bundle. Placard 14 includes a front surface 24 on which indicia/graphics are applied that are themed for a specific event such as a graduation, a birthday party, a holiday like Christmas, Easter, St. Patrick's Day, Fourth of July, etc. Loop 16 is secured to a rear surface 25 (see FIG. 6) of placard 14 via glue, a sticker or mechanically as described hereafter. The indicia on surface 24 is viewable while a utensil bundle is secured by the assembly 10.

While placard 14 may be formed of any rigid or semirigid material, in particularly advantageous embodiments, placard 14 is formed of a hard paper card stock material so that the entire assembly 10 can be produced at a price point that allows purchase of the assembly 10 for single use and disposal thereafter. Disposable assemblies 10 are advantageous as they allow an event host to provide specially themed utensil bundle securing assemblies for very specific occasions as opposed to having to make do with less specialized napkin rings that were purchased for some other or for general occasions. In other cases, placard 14 may be formed of rigid plastic, thin wood or laminated fibrous material, metal (e.g., aluminum), etc. The placards 14 may have many different shapes including circular (see Figs. generally), square (see 14*a* in FIG. 3) or any other shape. In some cases, the shapes may be selected to be part of the decoration that distinguishes placards for specific events. For instance, the shape may be an outline of a cartoon character for a child's birthday party, the outline of a phrase (e.g., "Happy Birthday", etc.), the outline of a trophy for a victory celebration, etc., where the graphic or indicia on the front placard face is consistent with the theme of the outline.

In at least some cases a host may order a set of assemblies 10 on line or in some other fashion and the assemblies 10 may be delivered in a completely assembled form intended for a single use as indicated above. For instance, for a Fourth of July party, a host may order 30 assemblies 10 with one or more patriotic themes reflected on the placard faces. Here, the placards 14 may be secured to the loops 16 in any fashion including, for instance, via glue, mechanically (e.g., a rivet or a staple of some type), etc.

One particularly advantageous mechanism for securing a placard 14 to a loop 16 is via a sticker 26 as shown in FIGS. 5 through 9. The sticker 26 includes a front surface 31 and a rear surface 27 where a glue layer 28 is formed on the rear surface 27. While shown as having non-glued tab sections 29 along upper and lower edges of the rear surface 27, in some cases the glue layer 28 will completely cover rear surface 27. In some embodiments the sticker shape and dimensions will be similar to the shape and dimensions of the rear surface of the placard so that the sticker substantially covers the entire rear surface once attached. In other cases, as shown in the figures, the sticker may have dimensions that are smaller than the dimensions of the rear surface of the placard so that ends of the strand arrangement that extend from the sticker behind the placard 14 extend from locations that are spaced inward from the placard edges. In cases where the sticker has smaller dimensions than the rear surface of the placard, the placard can extend sideways further than a utensil bundle secured via the assembly 10 (see again FIG. 2) so that the placard has a more prominent appearance.

In particularly advantageous embodiments, the placard has a width dimension between lateral edges that is between one half an inch and two inches and in particularly advantageous embodiments the placard width may be within a range between ¾ths of an inch and one and one quarter inches. The dimension between a lateral edge of the sticker and an adjacent lateral edge of the placard will, in some cases have a dimension between one eighth of an inch and one inch and in some embodiments the dimension will be between one quarter inch and three quarters of an inch.

To secure placard 14 to a loop section, the placard is placed adjacent the loop section and sticker 26 is applied to a rear surface of the placard with the strand 12 passing there between. In FIGS. 5 through 9, strand 12 is shown forming the placard engaging knot 34 but in other embodiments the strand 12 would not form the knot 34 and instead the sticker 26 would simply secure placard 14 to strand 12. Branding indicia or graphics may be provided on the front surface of the sticker as shown at 31 in FIG. 6.

In operation, with an assembly loop 16 loosened, a utensil bundle (see 30*a* in FIG. 2) is slid half way through the loop 16 and the placard 14 is arranged so that the themed graphics or indicia on the front face thereof is facing away from the utensil bundle. Distal ends 12*a*, 12*b* of the assembly strand are pulled as indicated by arrow 80 to tighten the loop 16 about the bundle. To loosen the loop and remove the utensil bundle for use, a user simply pulls on the loop section of strand 12 so that the strand moves in the direction opposite direction 80 until the utensil bundle can easily be removed.

Referring still to FIGS. 5 through 9, in the illustrated embodiment, portions of sticker 26 adjacent upper and lower edge sections do not include glue so that tabs 29 are provided along those edges. Here, in at least some cases it is contemplated that the sticker 26 can be removed and discarded and a host may be able to attach another placard with a new sticker to the strand arrangement. Thus, for instance, a set of strand loop arrangements 12 may be used a first time for a graduation party and used a second and additional times for subsequent events with differently themed placards. In this case, the tabs 29 are useful for tearing a sticker off a placard to remove and discard the placard. In some cases, the placards may be designed to be stored and reused a second or more times for similar events.

Figure 10:
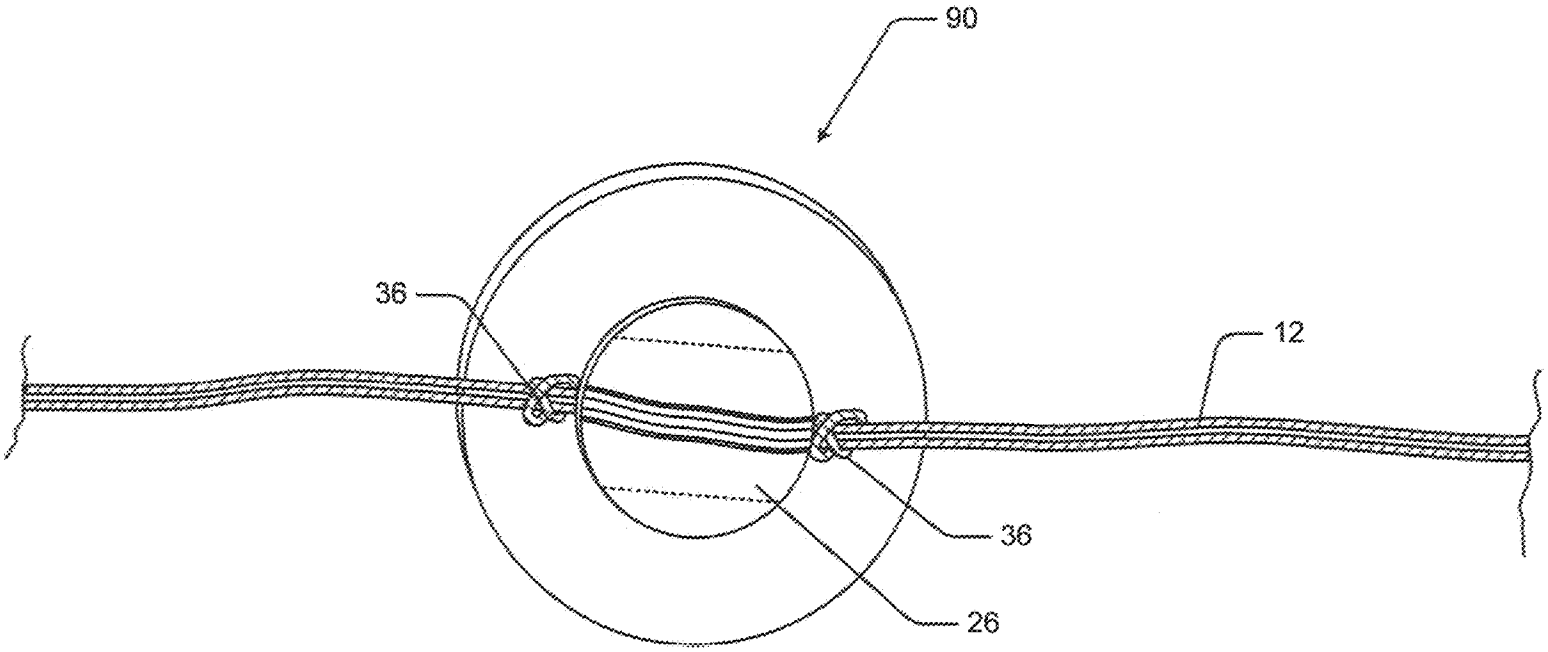
FIG. 10 is a rear view similar to the view in FIG. 7, albeit of another embodiment.

FIG. 10 shows another securing assembly 90 that is similar to the assembly shown in FIGS. 5 through 9, except that the strand 12 forms two securing knots 36 as opposed to a single knot 34. Here, the knots 36 are spaced apart the diameter dimension of a sticker 26 so that the sticker can be placed between the knots when securing to the rear of a placard 14. In cases where a host can remove placards and replace the placards with other themed placards, the engagement knot(s) 34 (or 36) are useful as a guide for where to attach the placard and sticker pairing.

Figure 11:
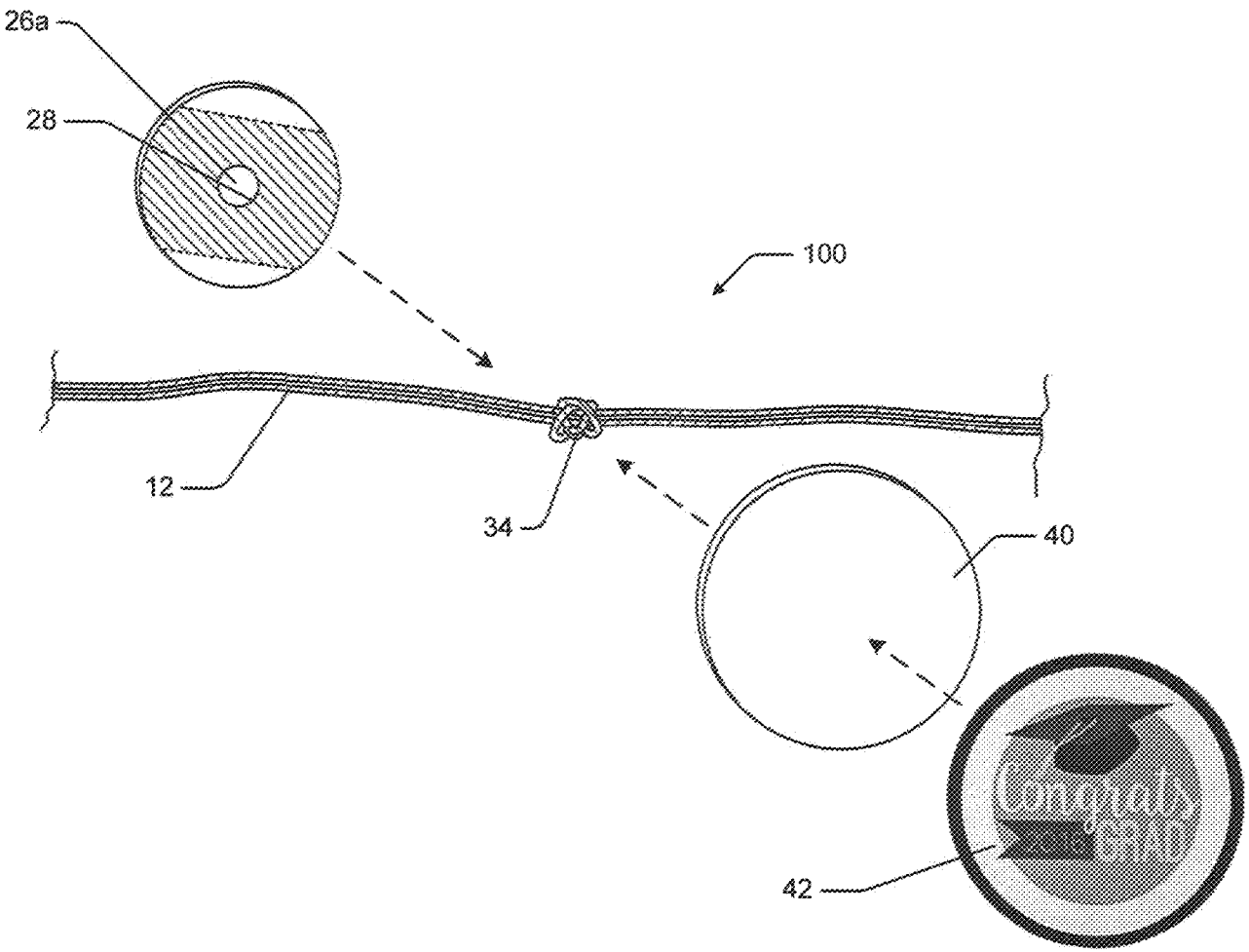
FIG. 11 is a partially exploded view of another embodiment of a securing assembly.

FIG. 11 shows another securing assembly 100 that includes a strand 12 that forms a single engaging knot 34 like the strand arrangement described above. In FIG. 11, however, the placard subassembly includes a plastic circular plate member 40 and a themed graphics indicia sticker 42 that secures to a front face of the plate member 40. In this case, a sticker 26*a* is provided for securing the plate member 40 to a strand at the engaging knot 34 in a manner similar to that described above with respect to sticker 26 and placard 14. In FIG. 11, the sticker 26*a* forms an opening 28 to help center the sticker 26*a* on the knot 34. The hole 28 is aligned with knot 34 when assembled. Here, instead of removing the placard 14 from the strand assembly to change out the themed graphics, the graphic sticker 42 can simply be peeled away from plate member 40 and a new themed sticker can be applied for a different event.

Figure 12:
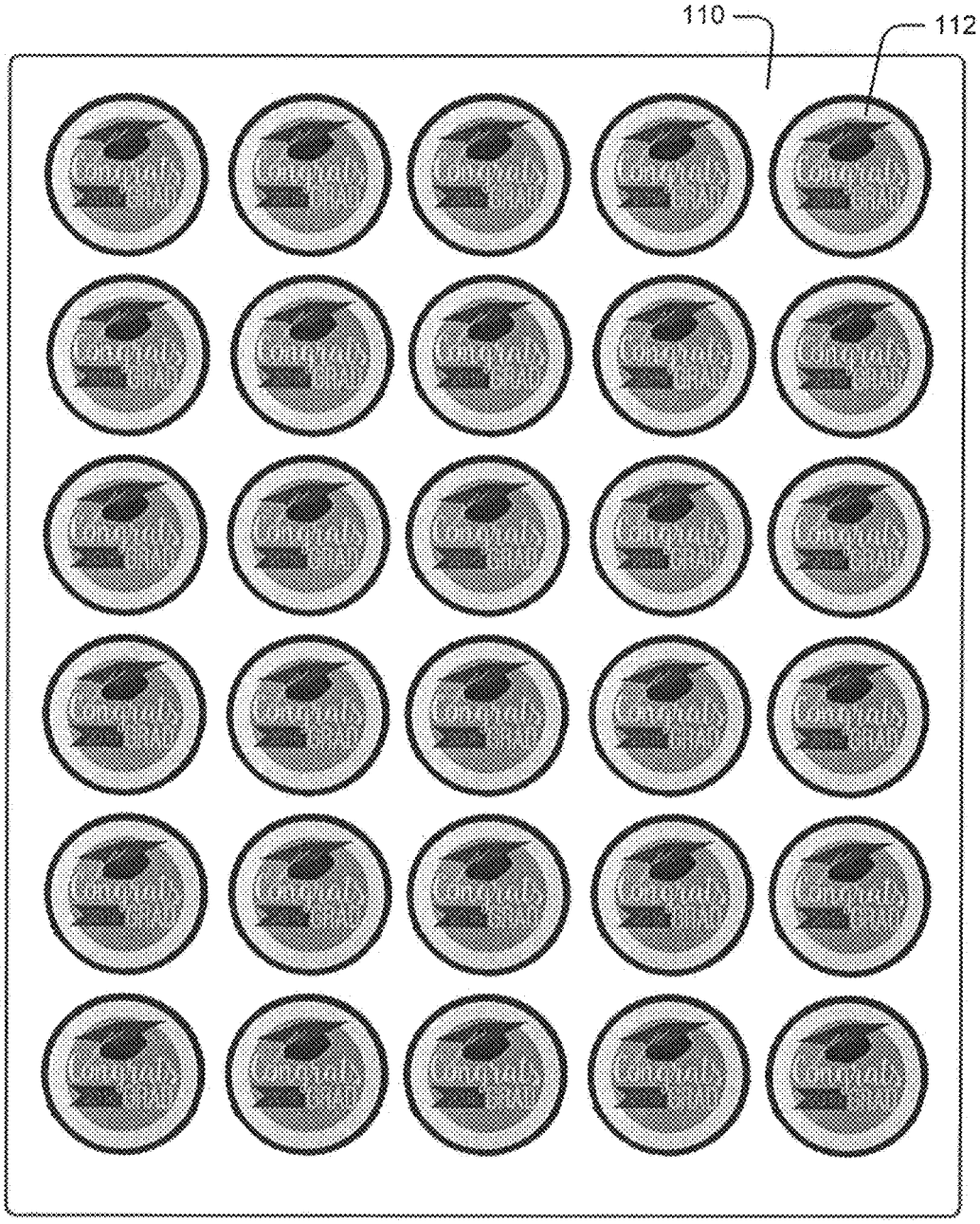
FIG. 12 is a plan view of a placard or sticker sheet that is consistent with at least some aspects of the present disclosure.
Figure 13:
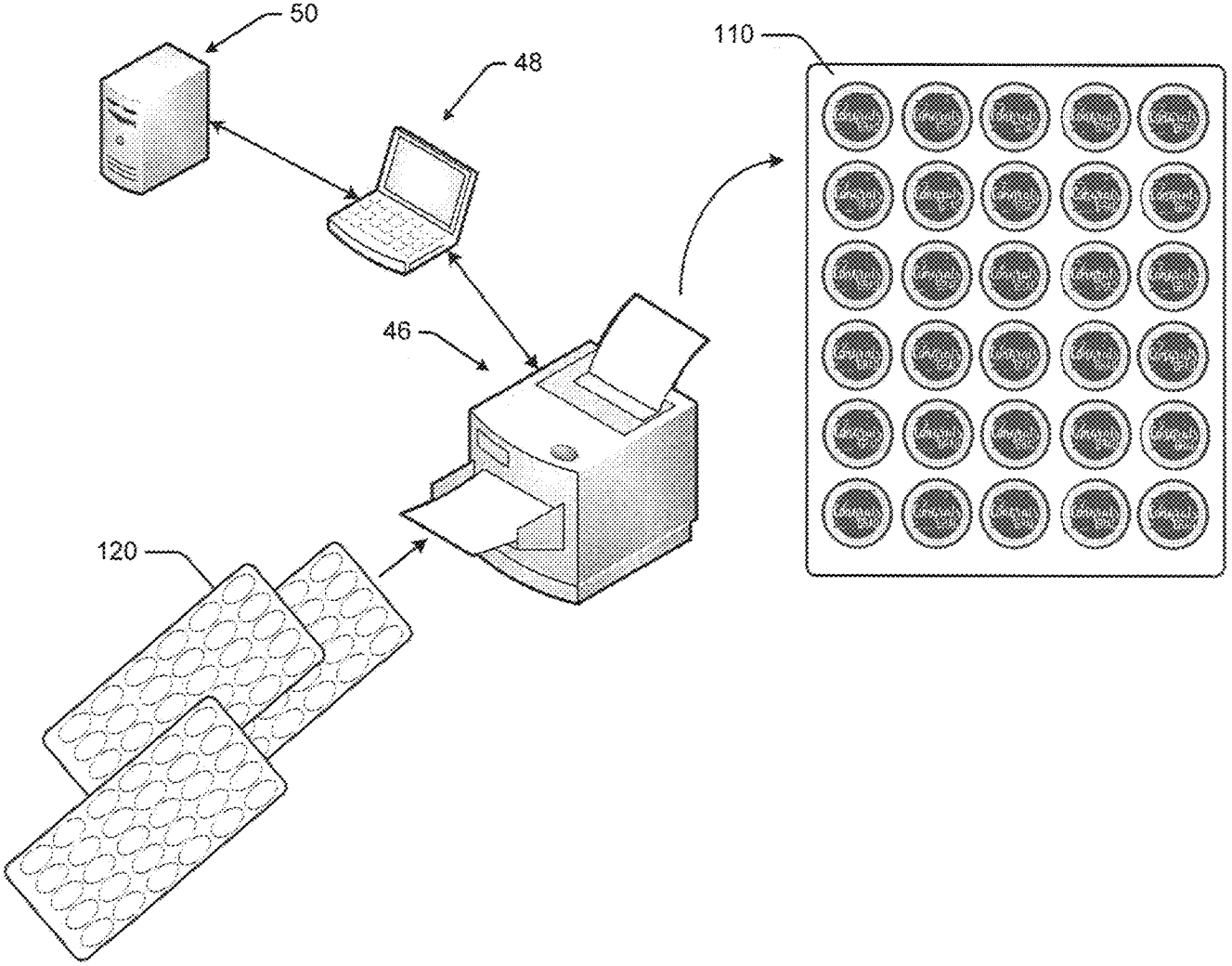
FIG. 13 is a schematic view of a printing assembly that is useful in practicing some embodiments of the present disclosure.
Figure 14:
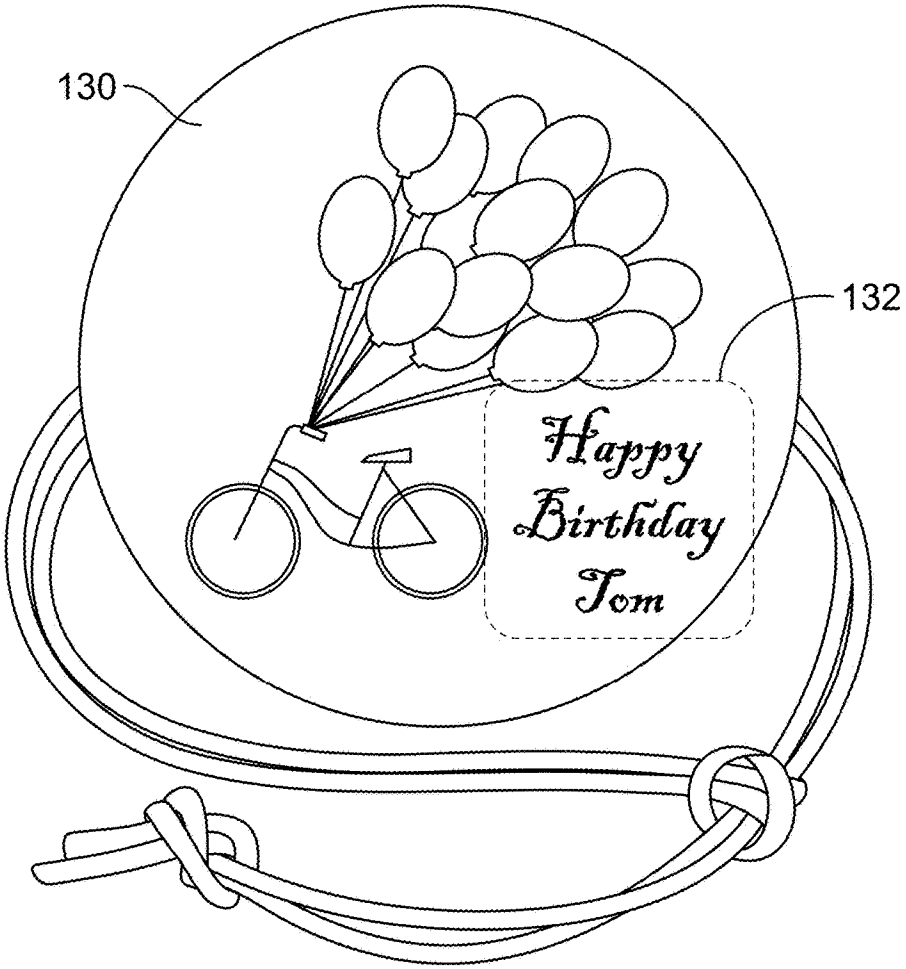
FIG. 14 is a view similar to the FIG. 1 view, albeit showing a personalized placard.
Figure 15:
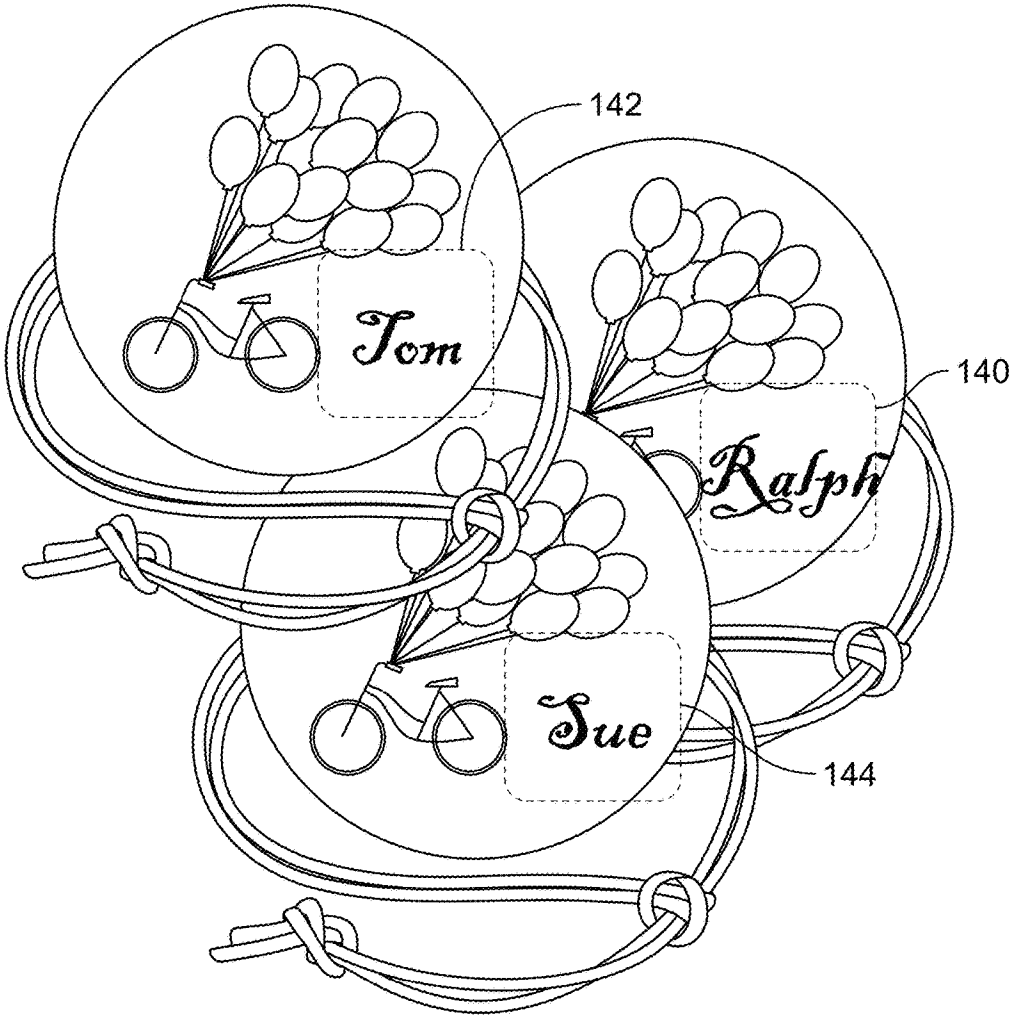
FIG. 15 is similar to FIG. 14, albeit showing several placards that have been personalized.

In some cases it is contemplated that a host may purchase a full kit of parts that includes themed placards or stickers for many different events or event types (e.g., 30 placards for graduation, 30 placards for Easter, 30 placards for birthdays, etc.) as well as a large set of stickers so that the host can routinely replace the placards for different events. In other cases, it is contemplated that a host may order a set of securing assemblies 10 for a first event and then order new placards or stickers for subsequent events where the new placards to stickers are then delivered when needed. To this end, see the exemplary graduation sticker set in FIG. 12 that includes a set of individually peelable stickers 112 on a sticker sheet 110. The set in FIG. 12 may also include embossed placards that can be removed by applying a minimal force to the edges of each placard. The stickers or placards would then be applied to the strand arrangements as described above.

Where stickers or placards can be ordered in sheets as shown in FIG. 12, in at least some embodiments, a host may have acquired a sticker or placard blank that includes stickers or placards that can be printed on using a high quality home printer. In this case, the host may be able to order different graphics or indicia and have those graphics or indicia printed on the stickers or placards without having to wait for those components to arrive via regular mail. In this regard, see FIG. 13 where a printer 46 is linked to a host's laptop computer 48 which is in turn linked via the Internet or the like to a service provider's server 50. In this case, the host using laptop 48 accesses a browser web page or the like operated on server 50, selects graphics and/or indicia for a placard or sticker set, feeds blank sheets in as indicated at 120 and prints out customized placards or stickers as at 110 that can then be attached to strand loop arrangements 12 in any of the ways described above.

Where a host can order placards or stickers on line, in at least some embodiments the host may be able to further personalize/customize placards/stickers for different events. For instance, see in FIG. 14 that indicia at 132 has been personalized for a specific person's birthday on placard 130. Further personalization is shown in FIG. 15 where specific guest names have been added to separate placards/stickers at 140, 142 and 144. Here, personalization can be done neatly and cleanly so a host can avoid manually applying (e.g., with pen in hand) personalized indicia which is time consuming and often times has poor results.

Figure 16:
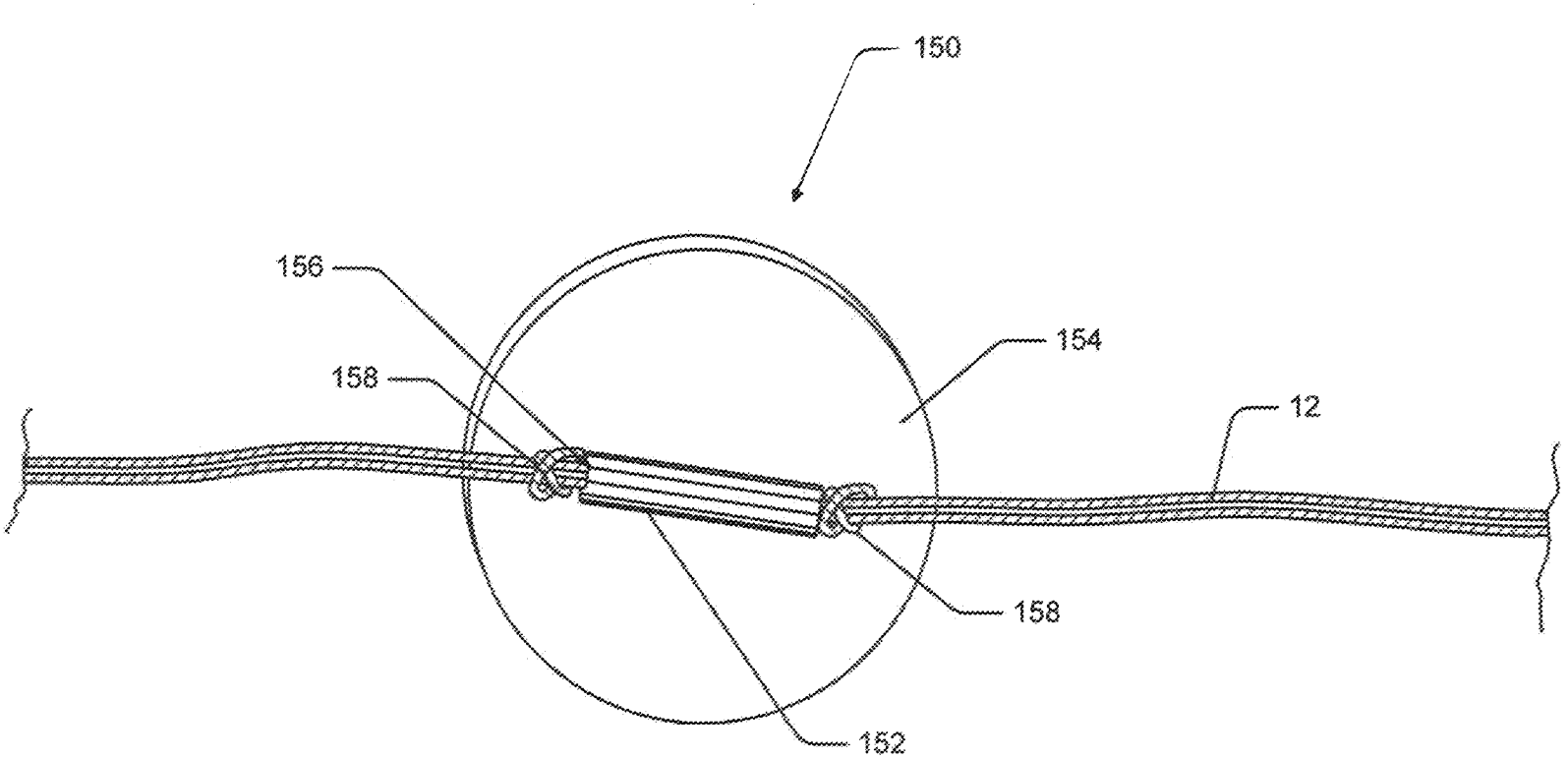
FIG. 16 is a rear view similar to the FIG. 7 view, albeit showing another embodiment.

FIG. 16 shows yet another embodiment 150 where a plate member 152 is attached to a strand assembly 12 mechanically. In FIG. 16, a plastic plate member 154 includes an integrated plastic tube 152 that extends centrally along a rear surface of the plate member 154. The tube 152 forms a channel 156 through which the strand arrangement extends. Here, first and second knots 158 are formed in the strand 12 that are spaced apart on oppose ends of the channel to secure the plate member 150 at a specific location along the length of the strand 12 which is located at a specific location along the loop 16 (see again earlier figures). In other cases, the plate 154 may be allowed to slide along the loop section of the strand to different locations or along a portion of the strand limited by one or two knots 158 that are further spaced apart. In the FIG. 16 embodiment, a graphic/indicia sticker would be applied to the front surface of the plate member 150.

Figure 17:
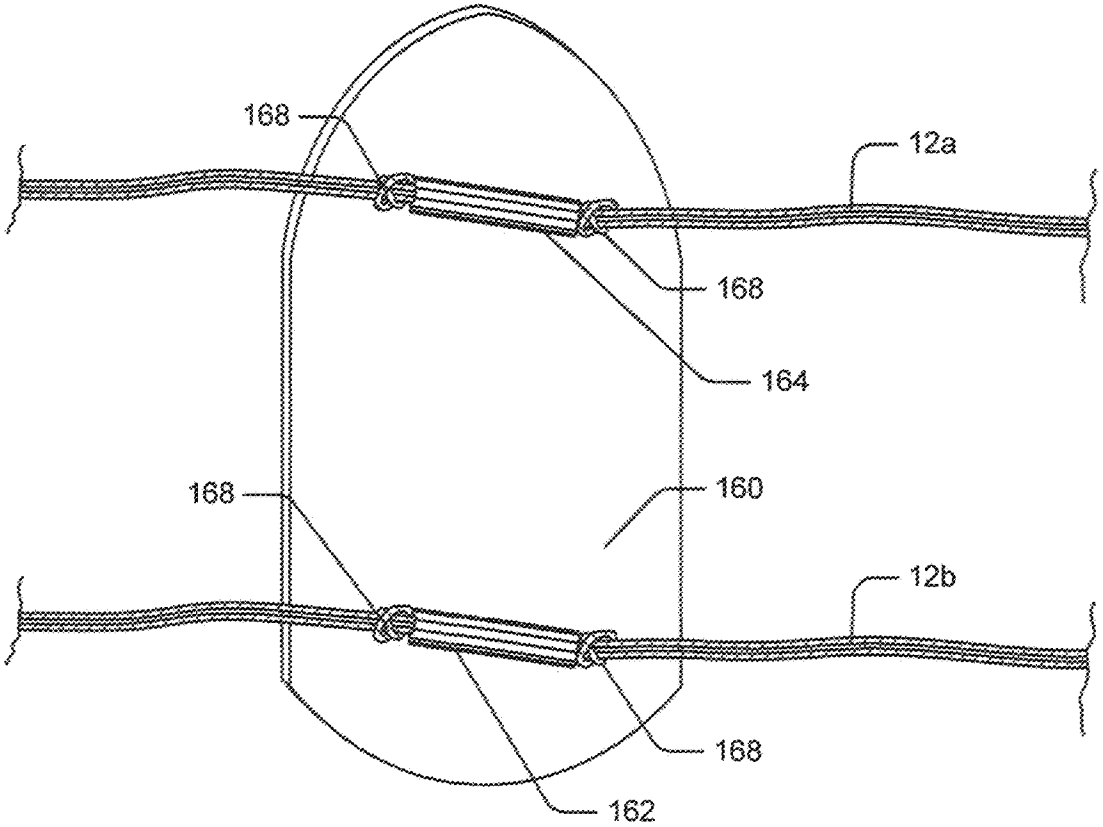
FIG. 17 is a rear view similar to FIG. 16, albeit showing a dual strand arrangement assembly.
Figure 18:
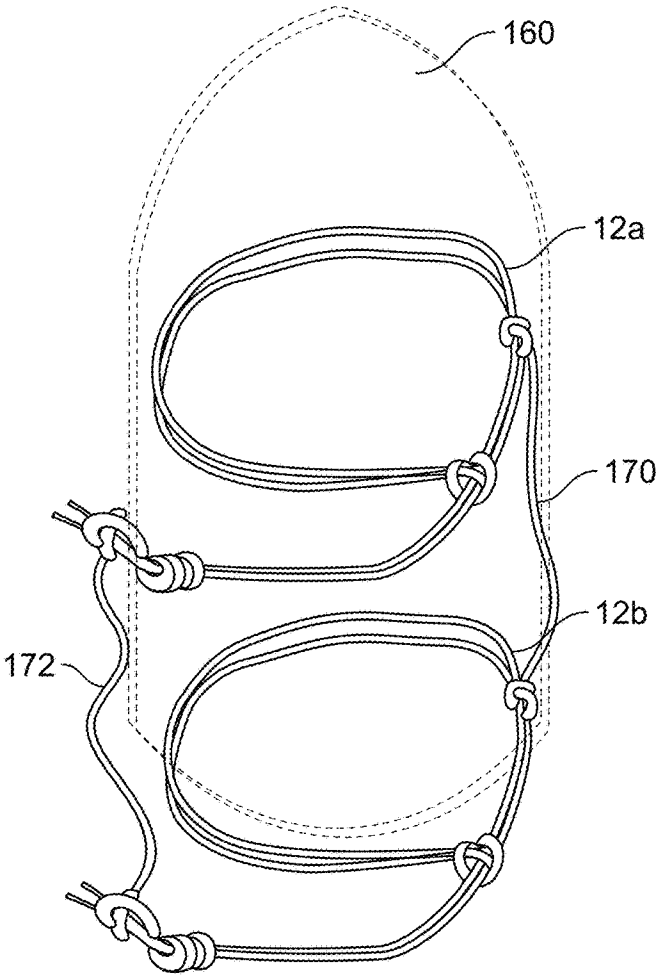
FIG. 18 is a perspective view of a dual strand arrangement assembly without an attached decorative placard, and including pull strings or strands that link sections of the dual strand arrangements so that the strand arrangements can be tightened and loosened in unison.

FIG. 17 shows another embodiment that includes two strand arrangements 12*a* and 12*b* and a single plate member 160 where two tube shaped members 162 and 164 are integrated into a rear surface of the plate member 160 to form substantially parallel channels that extend along a trajectory that extends between lateral edges of the plate member 160. As shown, the strands 12*a* and 12*b* extend through the tube channels and are locked thereto by alignment knots 168 on either end of each of the channels. In this case, a utensil bundle would be slid into two loops (e.g., see again the loop 16 in the figures above) and each of the strands 12*a* and 12*b* would be tightened through its own slip knot to secure the bundle in a closed state. In at least some cases the distal ends of the two strand assemblies 12*a* and 12*b* may be tied together so that the distal ends can be pulled in unison to tighten the combined strand assembly around a utensil bundle. Similarly, in some cases, the strand assemblies 12*a* and 12*b* may also be tied together along the loop sections so that the combined assembly can be loosened about a utensil bundle in unison. In this regard, see the "extra" string sections at 170 and 172 that are tied to the strand arrangements 12*a* and 12*b* in FIG. 18 where strand 172 can be pulled to loosen arrangements 12*a* and 12*b* and strand 172 can be pulled to tighten the arrangements 12*a* and 12*b*. While not shown other embodiments are contemplated that include three or more strand arrangements akin In still other embodiments two or more placards or plate members may be attached to a single strand loop section 16.

What is claimed is:

1. A utensil bundle assembly comprising:

a single strand having a first end and a second end and an intermediate portion therebetween, the intermediate portion forming a single slip knot that forms a slip knot channel through which the first and second ends pass, strand portions adjacent the first and second ends moveable through the slip knot channel to different locations to adjust the dimension of a loop portion formed by the strand while a dimension formed by an internal surface of the channel substantially persists; and a placard including a front surface and a rear surface, the placard mounted to the loop portion of the strand with the front surface exposed.

2. The assembly of claim 1 wherein the strand portions that are received in the channel are formed of a material that causes friction between the channel surface and the strand portions received in the channel.

3. The assembly of claim 2 wherein the strand includes waxed braided cotton string.

4. The assembly of claim 1 wherein the strand is formed of an elastic material.

5. The assembly of claim 1 wherein at least an intermediate portion of the strand is formed of an elastic material.

6. The assembly of claim 1 wherein a stop knot is formed at the first and second ends of the strand wherein the stop knot has a diameter dimension that is larger than the opening formed by the slip knot.

7. The assembly of claim 6 wherein a stop knot is formed within the loop portion of the strand wherein the stop knot has a diameter dimension that is larger than the opening formed by the slip knot, the stop knot spaced apart from the slip knot so that the stop knot limits the minimum diameter of the loop portion of the strand.

8. The assembly of claim 7 wherein the minimum length of the loop portion is between one half inch and one and two and one half inches.

9. The assembly of claim 7 wherein the minimum length of the loop portion is between one inch and one and one and one half inches.

10. The assembly of claim 1 wherein the strand forms at least one detent knot proximate the strand ends wherein the detent knot has a dimension slightly larger than a channel formed by the slip knot so that the detent knot can pass through the channel when sufficient force is applied thereto.

11. The assembly of claim 10 further including at least second and third detent knots spaced apart adjacent the strand ends.

12. The assembly of claim 1 further including at least a first placard engaging knot along the loop portion of the strand and wherein the placard engages the engaging knot when mounted to the strand.

13. The assembly of claim 12 wherein the placard engaging knot is spaced from the slip knot by a distance between one half an inch and two and one half inches.

14. The assembly of claim 1 wherein the placard is formed of cardboard.

15. The assembly of claim 1 wherein the placard is formed of a substantially rigid material.

16. The assembly of claim 1 further including a mounting sticker having adhesive on one side, a portion of the loop portion sandwiched between the adhesive side and the back side of the placard.

17. The assembly of claim 1 wherein the placard has a width dimension between lateral edges that is between one half inch and two inches.

18. The assembly of claim 1 wherein the placard has a width dimension between lateral edges that is between three fourths of an inch and one and one fourth of an inch.

19. A utensil bundle assembly comprising:

a single strand having a first end and a second end and an intermediate portion therebetween, the intermediate portion forming a single slip knot including a slip knot channel through which the first and second ends pass, strand portions adjacent the first and second ends moveable through the slip knot channel to different locations to adjust the dimension of a loop portion formed by the strand while an internal dimension of the channel persists, the strand formed of a material that causes friction between strand portions in the when channel and an internal surface of the channel, wherein a first stop knot is formed at the first and second ends of the strand wherein the stop knot has a diameter that is larger than the slip knot channel, wherein a second stop knot is formed within the loop portion of the strand wherein the second stop knot has a diameter dimension that is larger than the slip knot channel, the second stop knot spaced apart from the slip knot so that the second stop knot limits the minimum diameter of the loop portion of the strand.

20. A utensil bundle assembly comprising:

a single strand having a first end and a second end and an intermediate portion therebetween, the intermediate portion forming a single slip knot forming a persistently sized slip knot channel through which the first and second ends pass, strand portions adjacent the first and second ends moveable through the slip knot channel to different locations to adjust the dimension of a loop portion formed by the strand, wherein a stop knot is formed at the first and second ends of the strand wherein the stop knot has a diameter that is larger than the slip knot channel; and a decorative component including a front surface and a rear surface, the rear surface of the decorative component mounted to the loop portion of the strand with the front surface exposed.

* * * * *